US007275461B2

(12) United States Patent
Gherman et al.

(10) Patent No.: US 7,275,461 B2
(45) Date of Patent: Oct. 2, 2007

(54) MAGNETIC BLADE SHARPENING DEVICE AND METHOD

(75) Inventors: Richard Joel Gherman, P.O. Box 1312, Pebble Beach, CA (US) 93953-1312; David D. Hayslett, Pebble Beach, CA (US)

(73) Assignee: Richard Joel Gherman, Pebble Beach, CA (US)

( * ) Notice: Subject to any disclaimer, the term of this patent is extended or adjusted under 35 U.S.C. 154(b) by 0 days.

(21) Appl. No.: 11/367,603

(22) Filed: Mar. 4, 2006

(65) Prior Publication Data

US 2007/0074603 A1 Apr. 5, 2007

Related U.S. Application Data

(60) Provisional application No. 60/722,376, filed on Sep. 30, 2005.

(51) Int. Cl.
*B21K 5/12* (2006.01)

(52) U.S. Cl. ..... 76/82; 76/DIG. 8; 76/DIG. 9; 30/35; 30/74

(58) Field of Classification Search ..... 76/82, 76/DIG. 8, DIG. 9; 30/74, 35
See application file for complete search history.

(56) References Cited

U.S. PATENT DOCUMENTS

| | | | | | |
|---|---|---|---|---|---|
| 1,775,518 | A | | 9/1930 | Forbes | |
| 1,782,033 | A | | 11/1930 | Forbes | |
| 1,821,721 | A | | 9/1931 | Moyer | |
| 1,855,006 | A | | 4/1932 | Hamilton-Adams | |
| 1,914,925 | A | | 6/1933 | Nones | |
| 2,321,570 | A | | 6/1943 | Billing | |
| 2,370,815 | A | | 3/1945 | Ross | |
| 2,792,108 | A | | 5/1957 | Keller | |
| 3,031,757 | A | | 5/1962 | Kramer | |
| 3,114,204 | A | | 12/1963 | LaTulip | |
| 3,344,520 | A | * | 10/1967 | Williams | 30/200 |
| 4,615,436 | A | * | 10/1986 | Hastie | 206/208 |
| 4,773,158 | A | * | 9/1988 | Kertzman | 30/541 |
| 5,148,916 | A | | 9/1992 | Tillyer, Sr. | |
| 5,329,699 | A | | 7/1994 | McCoy | |
| 5,638,042 | A | * | 6/1997 | McCoy | 335/306 |
| 5,893,213 | A | * | 4/1999 | Motta | 30/540 |
| 6,035,535 | A | * | 3/2000 | Dischler | 30/48 |
| 6,443,305 | B1 | | 9/2002 | Stanford et al. | |
| 2001/0006069 | A1 | * | 7/2001 | Treskov et al. | 132/290 |
| 2004/0045407 | A1 | | 3/2004 | Katz | |
| 2004/0200080 | A1 | * | 10/2004 | Lauri | 30/541 |

FOREIGN PATENT DOCUMENTS

| | | |
|---|---|---|
| GB | 2218368 | 11/1989 |

* cited by examiner

*Primary Examiner*—Joseph J. Hail, III
*Assistant Examiner*—Robert Scruggs

(57) ABSTRACT

An apparatus and method for sharpening razor blades and the like whereby rectangularly-shaped magnets are placed end-to-end in a rectangular enclosure that snaps on securely over a razor blade during non-use times in such a manner that the magnetic field generated by the magnets acts upon the cutting edge of the blade so as to maintain the sharpness of the cutting edge.

17 Claims, 9 Drawing Sheets

MAGNETIC BLADE SHARPENING DEVICE AND METHOD

CROSS-REFERENCE TO RELATED APPLICATION

This application claims the benefit of Provisional Patent Application Ser. No. 60/722,376, filed Sep. 30, 2005.

FEDERALLY SPONSORED RESEARCH

Not Applicable

Sequence Listing or Program

Not Applicable

BACKGROUND

1. Field of the Invention

The present invention relates to extending the useful life of a cutting edge. More particularly, the present invention relates to magnetically maintaining or restoring the sharpness of the cutting edge of any given blade.

2. Description of the Prior Art

Cutting edges on knives, scissors, and the like and on razor blades in particular have a limited useful cutting or shaving life. While abrasion and friction-dulling are certainly contributing factors in limiting the useful life of any cutting edge, corrosion damage has also been found to be a major cause of dull edges on cutting edges in general and on shaving devices in particular.

Corrosion typically occurs when the free electrons in the metallic razor blade flow across the boundary edge and into the water shaving solution. Razor blades are normally made of ferromagnetic materials which act as conductors with large numbers of these free electrons. These electrons accumulate on the sharp cutting edge of the blade in an uneven manner and these uneven accumulations begin to act like electrodes which release these accumulated electrons from the cutting edge. These resultant metallic ions are absorbed by the water shaving solution thereby causing the gradual deterioration or corrosion of the metallic cutting edge.

Various blade sharpening devices are described by the prior art including some that purportedly use the effects of a magnetic field to restore and/or maintain the sharpness of the cutting edge of a given blade. For example, U.S. Pat. No. 1,775,518 issued to Forbes (1930) and U.S. Pat. No. 1,782,033 also issued to Forbes (1930) both describe the use of a magnetic influence to produce or maintain a good edge on a razor blade. Similarly, U.S. Pat. No. 2,321,570 issued to Billings (1940) disclosed a chamber containing magnets which would magnetically treat the blades stored therein. These types of sharpeners and many of their progeny were of limited commercial utility because they either required the use of large horseshoe-type magnets, which were both expensive and cumbersome, or they required specially configured magnets that were expensive and generally unavailable absent special production orders. Other devices, such as that disclosed by U.S. Pat. No. 2,792,108 issued to Keller (1957) purport to magnetically align the minute bends and distortions that occur in a razor blade during normal usage. However, this device required the use of magnets that were housed in a large rectangular chamber into which a razor blade or a razor with a razor blade attached would be inserted for reconditioning. In fact, most of the prior art required that the blade being sharpened be placed in some type of large, bulky vessel or container that seriously limited or negated its transportability, The device disclosed by U.S. Pat. No. 4,615,436 issued to Hastie (1986) sought to overcome the shortcomings inherent in the aforementioned devices by providing a magnetic influence at an angle of 45 degrees incident to the plane of the blade so as to maintain the sharpness of the cutting edge. However, this device also required the use of magnets housed in a large rectangular chamber into which a razor with a razor blade attached would be inserted for reconditioning. This chamber was cumbersome and would typically use up a significant amount of space in a shaving kit or overnight bag which, in turn, restricted the user's ability to take the device with him while traveling. Further, even if the chamber were placed in a shaving kit or traveling bag, this device, like most, if not all of the prior art, had no means of keeping the blade securely fastened to the sharpening device. The blade could easily be knocked loose from the sharpening device thereby interrupting the restoration and/or maintenance process and also exposing the user to the risk of cutting himself on the unprotected cutting edge.

Some inventors sought to overcome the bulky, horseshoe-magnet problem by using a linear, end-to-end alignment of rectangular-shaped bar magnets. For example, U.S. Pat. No. 5,329,699 issued to McCoy (1994) and U.S. Pat. No. 5,638,042 also issued to McCoy (1997) disclose a linear, end-to-end alignment of magnets in a device that essentially fits over the object's cutting edge. U.S. Pat. No. 4,615,436 issued to Hastie (1986) also discloses a linear, end-to-end placement of magnets, albeit at a 45-degree angle to the plane of the blade being sharpened. However, these devices, as well as all other prior art disclosing a linear disposition of bar magnets, teach a linear alignment with opposite poles adjacent to one another. In fact, the prior art stresses the "scientific necessity" of aligning such magnets with opposite poles adjacent to one another. Further these devices, like all other devices disclosed by the prior art could only be placed on a horizontal surface where it would necessarily take up space that the owner might want to remain otherwise uncluttered.

Further, most of the prior art teaches blade-sharpening devices that are limited to use with shaving razors. U.S. Pat. No. 5,638,042 issued to McCoy (1997) discloses a device that fits over a generic cutting edge but this device, like all of the other prior art, teaches an alignment of magnets whereby opposite poles are adjacent to one another.

Objects and Advantages

The present invention seeks to overcome these shortcomings by providing a blade sharpener that is simple in construction, ergonomically efficient, and durable while still meeting the stated needs of the consumer for a reasonably priced blade sharpener.

Accordingly, the objects and advantages of the present invention are:

(1) to provide a blade sharpener which uses small magnets to recondition the cutting edge of the blade to which it is attached.

(2) to provide a blade sharpener that maintains and restores the sharpness of the cutting edge of the blade to which it is attached.

(3) to provide a blade sharpener that is simple to construct, economical in price and easy to use.

(4) to provide a blade sharpener that the increases the useful life of the blade to which it is attached.

(5) to provide a blade sharpener that fits over the blade to be sharpened instead of housing it.

(6) to provide a blade sharpener that is more compact and takes up less room than other commercially available blade sharpeners.

(7) to provide a blade sharpener than is easily transportable.

(8) to provide a blade sharpener that remains securely fastened to the blade while the blade is not in use.

(9) to provide a blade sharpener than can be used to restore and/or maintain any cutting edge.

(10) to provide a blade sharpener that can be mounted on a vertical surface.

Additional objects, advantages, and novel features of the invention will be set forth in part of the description which follows, will become apparent to those skilled in the art upon examination of the following specification, or may be learned through the practice of the present invention.

SUMMARY

This invention provides an apparatus and method for maintaining or sharpening the cutting edge of a blade while the blade is not in use.

DRAWINGS

Drawing Figures

Reference Numerals in Drawings

| | | | |
|---|---|---|---|
| 11 | razor | 12 | handle |
| 13 | razor head | 20 | casing |
| 21 | side | 22 | tab |
| 23 | magnet | 24 | supporting body |
| 25 | channel | | |

DETAILED DESCRIPTION

Description—Simplest Embodiment

Figure 1:
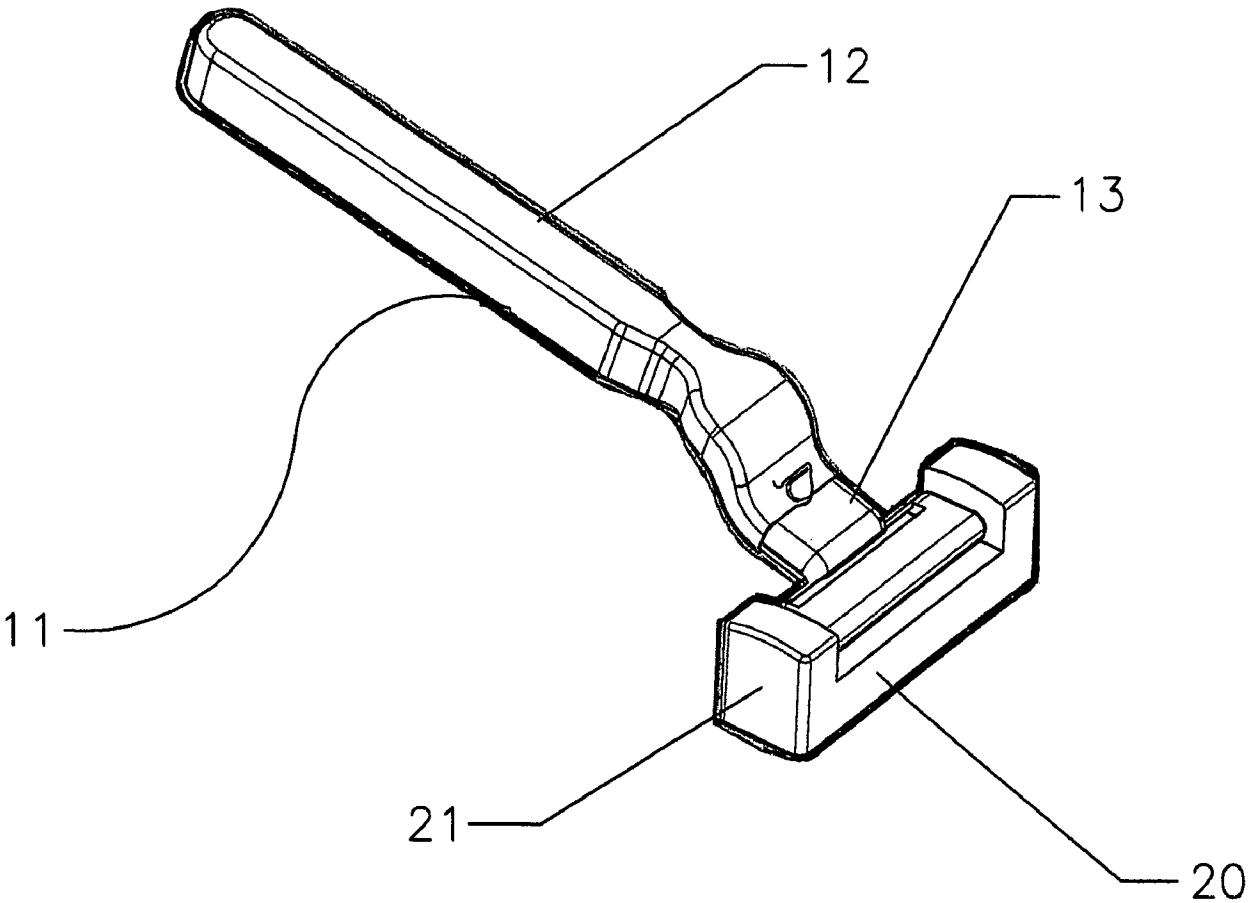
FIG. 1 is a perspective view of the simplest embodiment of the present invention mounted on a typical hand-held razor.
Figure 2:
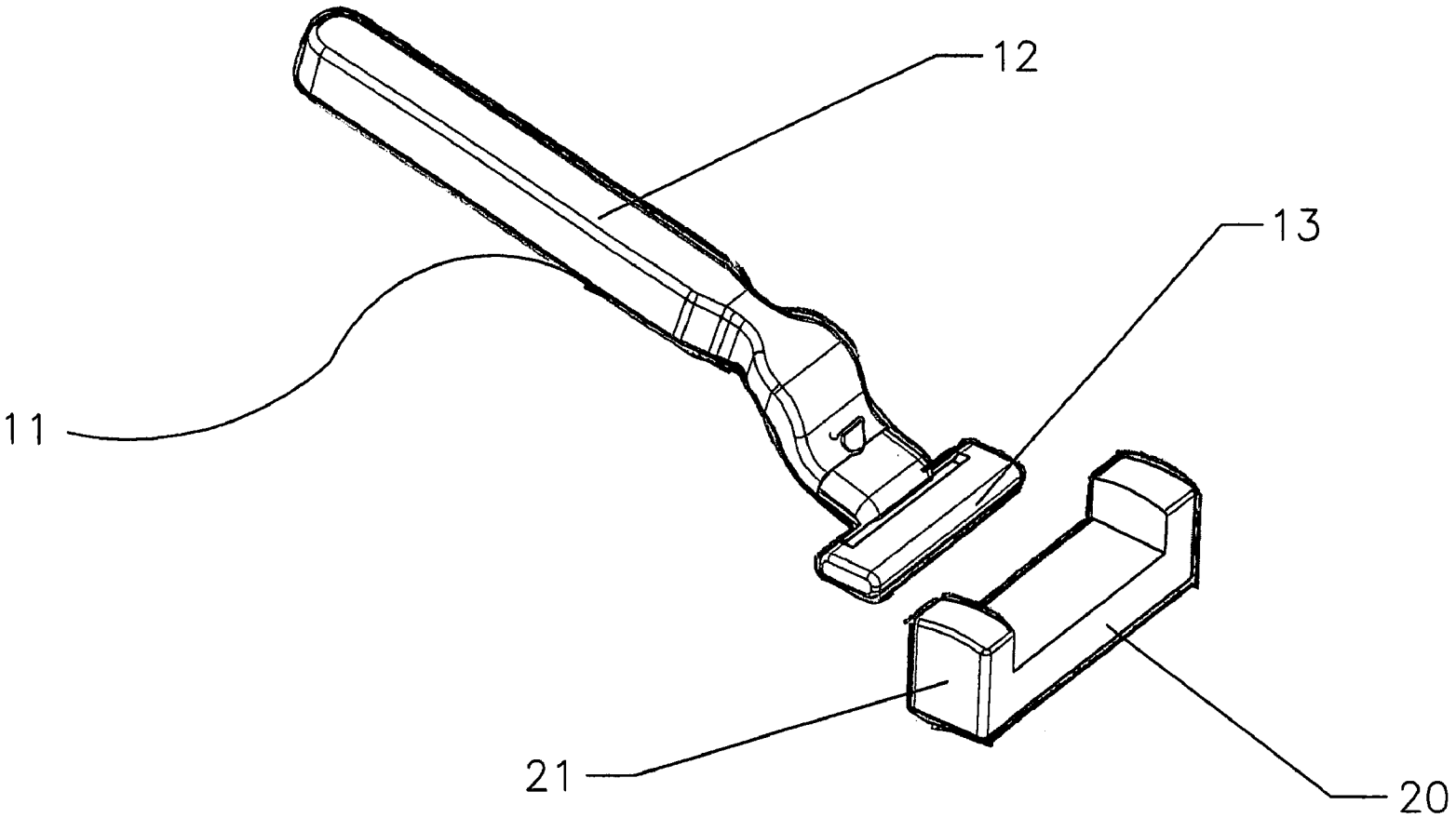
FIG. 2 is a perspective view of the simplest embodiment of the present invention separated from a typical hand-held razor.

FIG. 1 shows a perspective view of the simplest embodiment present invention as it would appear when mounted on and attached to a typical hand-held razor 11 while FIG. 2 shows a perspective view of the simplest embodiment of present invention separated from a typical hand-held razor 11.

FIG. 1 and FIG. 2 also show a typical hand-held razor 11 having a shaft-like handle 12 by which the user grips razor 11 and holds it while shaving. One to three separate razor blades are mounted within and project outwardly from razor head 13 thereby permitting the cutting edge of said razor blade(s) to shave body hair and/or facial whiskers off the skin of the user. When not in use, razor head 13 is placed on or inserted into a rectangular casing 20 with extended sides 21 that keep razor head securely and firmly in place.

Razor 11 may be formed of any suitable material including, without limitation, plastic, metal, fiberglass, or other such suitable, lightweight and durable materials. The razor blades projecting outwardly from razor head 13 are typically manufactured from a thin, flexible sheet of stainless steel or other similar magnetic material and having one or more edges that have been specially treated or coated and sharpened so as to efficiently shave body hair and/or facial whiskers off the skin of the user. It will be appreciated by one skilled in the art that razor 11 is commercially available in numerous configurations displaying a large variety of sizes and shapes for handle 12 and razor head 13. It will also be appreciated by one skilled in the art that the razor blades projecting outwardly from razor head 13 are also commercially available in a variety of sizes and configurations such as single and double-edged blades; single, double, and triple parallel rows (tracks) of blades; lubricated and non-lubricated blades; and other such variations. The present invention contemplates compatibility and use with any and all such varying sizes and configurations of razors, razor heads, and razor blades.

Figure 4:
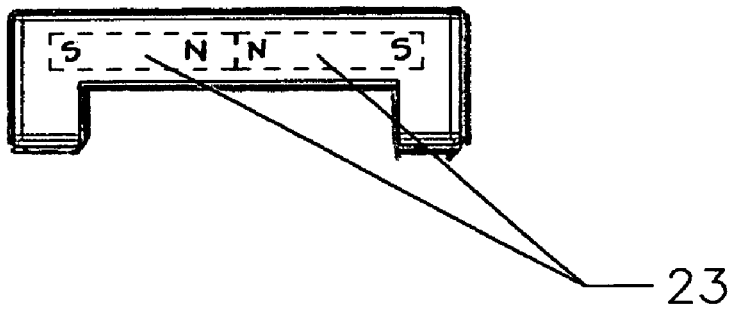
FIG. 4 is a front elevation of the simplest embodiment of the present invention showing the disposition of magnets in the rectangular casing.
Figure 3:
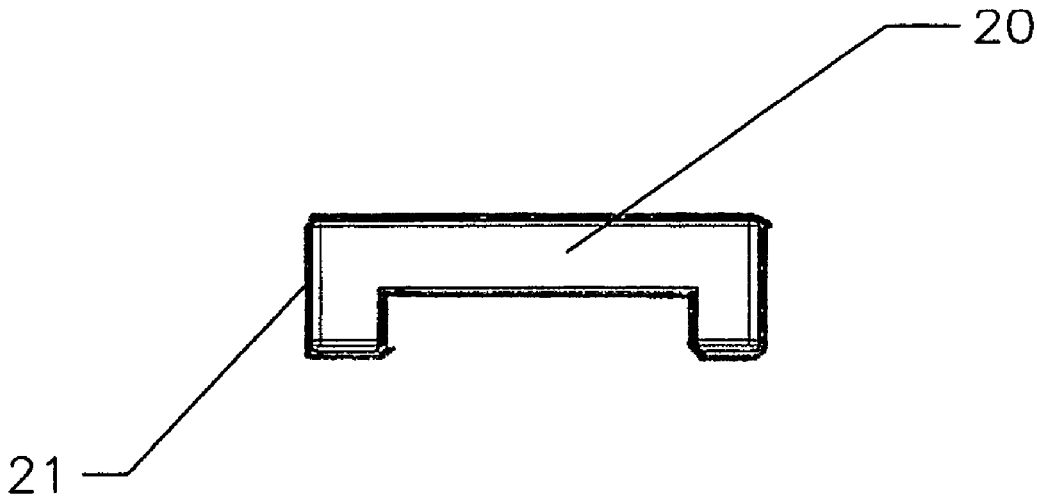
FIG. 3 is a front elevation of the simplest embodiment of the present invention.

FIG. 3 and FIG. 4 show a front elevation of the simplest embodiment of the present invention in its unattached state. This embodiment comprises an open rectangular casing 20 with farthest opposing sides 21 extended and perpendicular to casing 20 so that the present invention will tightly and securely fit around razor head 13 as shown in FIG. 1. This embodiment is designed in such a manner that the inner surfaces of opposing sides 21 are in direct, physical contact with the outer surfaces of the opposing sides of razor head 13 which, in turn, constitutes the means for keeping the present invention securely fastened to razor head 13 when it is not in use. Rectangular casing 20 and extended sides 21 are typically uniformly cast and may be composed of any suitable nonferrous and semi-rigid material such as nonferrous metal, plastic, rubber, epoxy, and the like and they may be composed of the same or different materials. Extended sides 21 are of sufficient thickness to permit some outward bending so as to permit insertion of razor head 13 into this embodiment of the present invention and then releasing extended side(s) 21 so as to securely hold razor head 13 onto the present invention by means of compressive force or surface friction with extended sides 21.

FIG 3 shows a front elevation view of the simplest embodiment of the present invention in its unattached state. FIG. 4 shows a front elevation of the same embodiment depicted in FIG. 3 but with two rectangularly shaped magnetic members 23 aligned in a polar end-to-polar end, like-poles-facing-and-touching disposition within casing 20. Aligning magnets 23 so that like polar ends are facing and touching one another provides for the optimal outward projection of the lines of magnetic flux so as to ensure that the maximum restorative effect of the magnets 23 reaches the razor blade(s) embedded in razor head 13. Alternative embodiments of the present invention contemplate dispositions whereby more than two rectangularly shaped magnets 23 are aligned in a polar end-to-polar end, like-poles-facing-and-touching disposition within casing 20.

Figure 5:
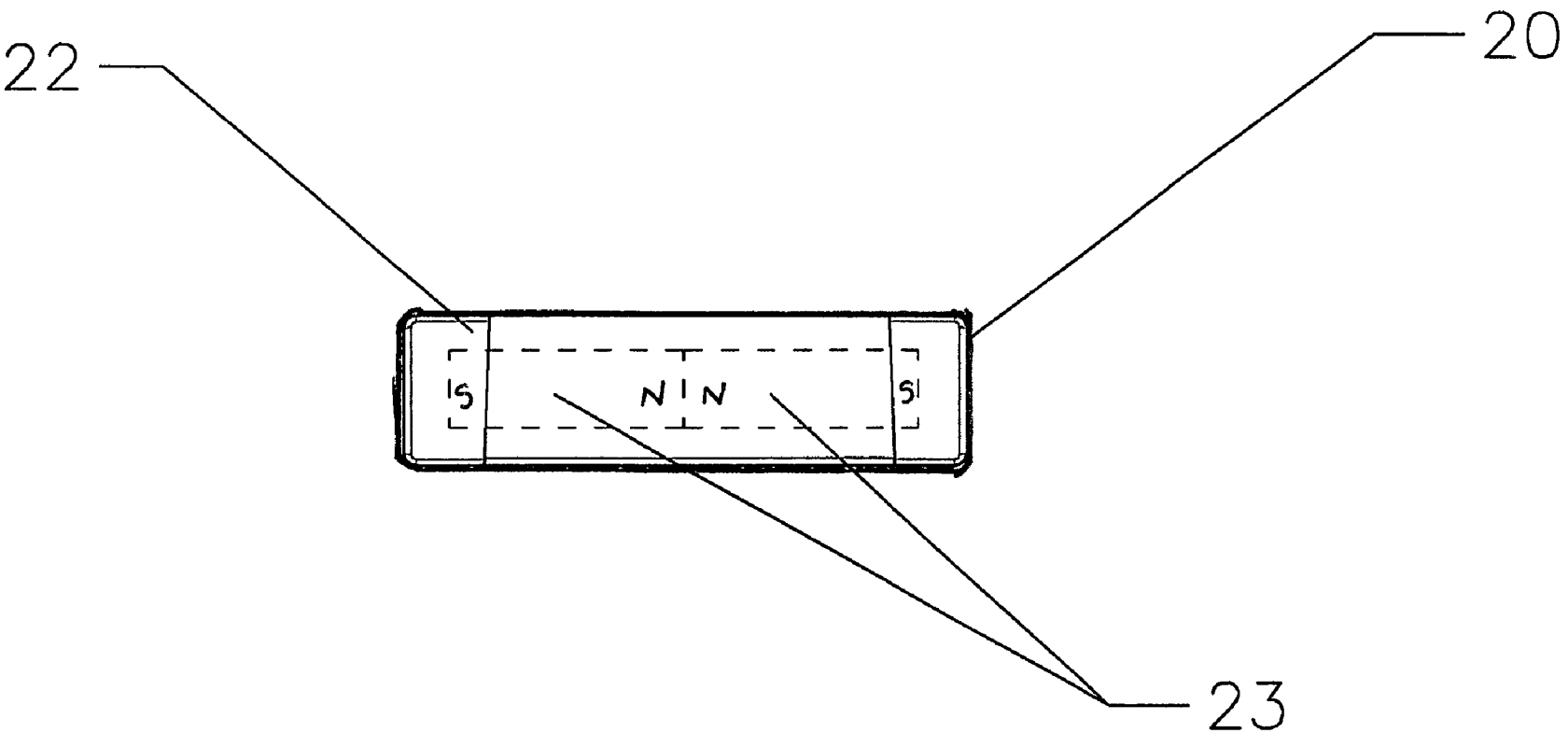
FIG. 5 is a top view of another embodiment of the present invention showing the disposition of magnets in a rectangular casing which would completely enclose the head of a typical hand-held razor.

FIG. 5 shows a top view of an alternative embodiment of the present invention where inwardly-extended tabs 22 touch each other to form a horizontal bar that intersects with a perpendicular extension of the upper front edge of casing 20 thereby creating a rectangular pocket that is open on the rearward side. The user simply inserts razor head 13 into this pocket when razor 11 is not in use.

In another embodiment of the present invention (not shown), extended sides 21 have, at their outer extremity, tabs 22 which are bent inwardly at a right angle to extended sides 21 and are of sufficient length to extend over a slight portion of the top of razor head 13 so as to securely hold the present invention in place over razor head 13 inserted therein. This embodiment, like that depicted in FIG. 5, permits greater flexibility in design because inwardly-extending tabs 22 provide the means for securing the present invention to razor head 13. Since the inner surfaces of extended sides 21 need not be in contact with the outer sides of razor head 13, the horizontal distance between the inner surfaces of extended sides 21 can be increased so as to accommodate the largest number of commercially available razor heads 13.

Description—Preferred Embodiment

Figure 6:
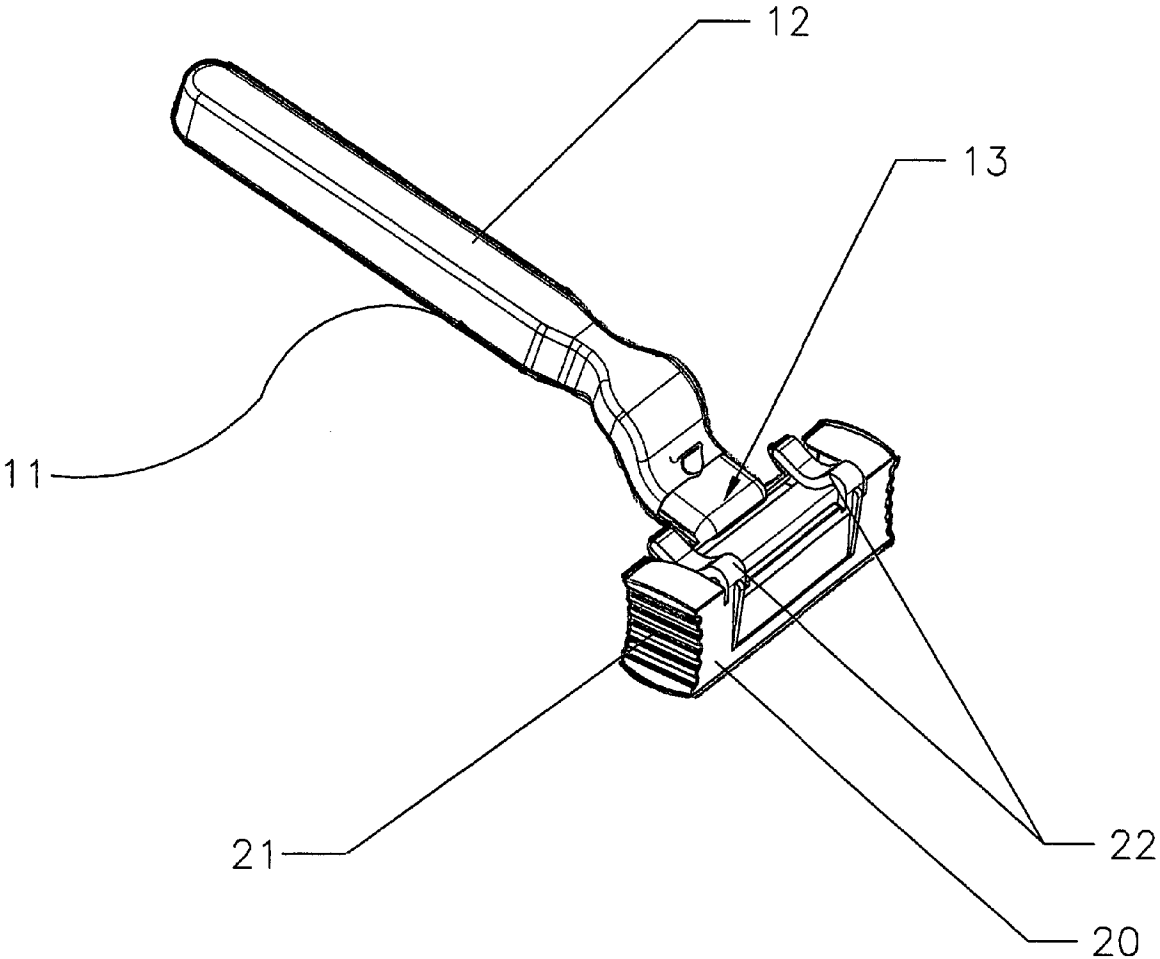
FIG. 6 is a perspective view of the preferred embodiment of the present invention mounted on a typical hand-held razor.
Figure 7:
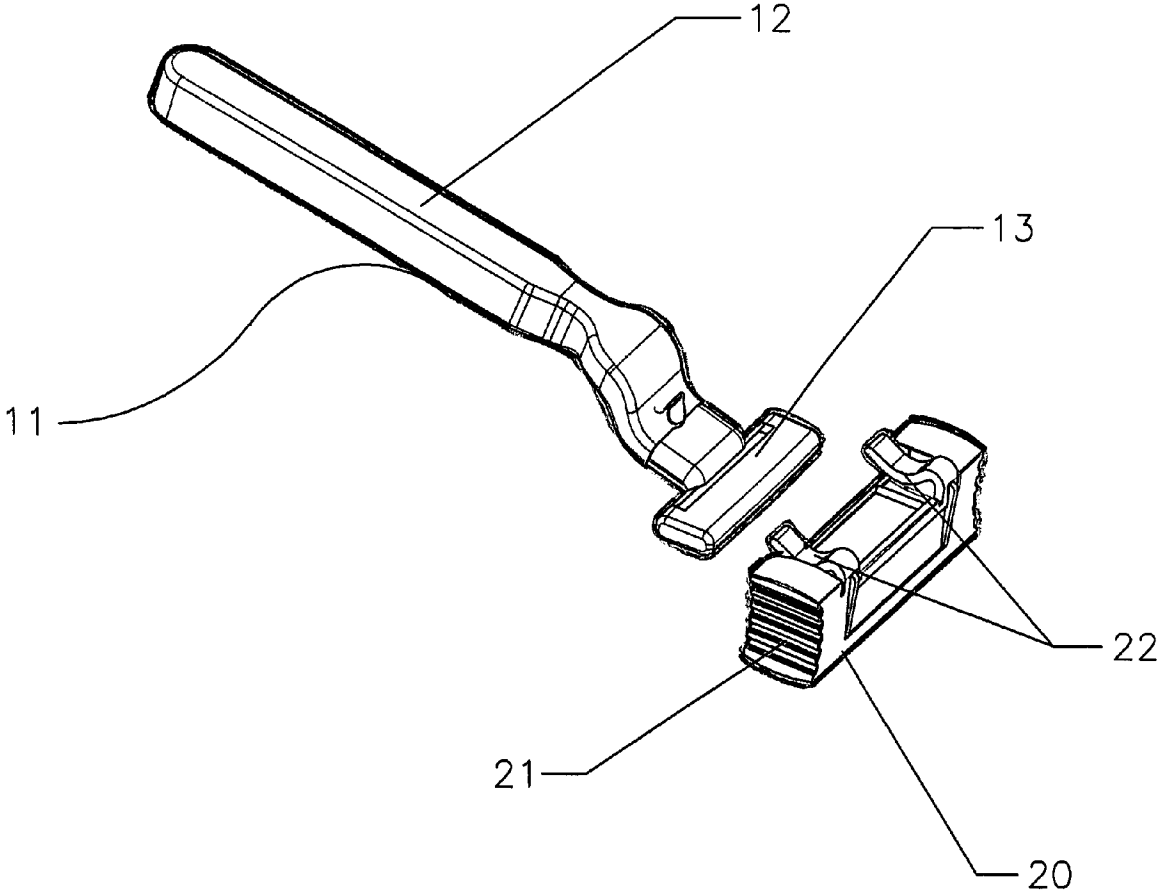
FIG. 7 is a perspective view of the preferred embodiment of the present invention when separated from a typical hand-held razor.

FIG. 6 shows the preferred embodiment of the present invention. Tabs 22 extend vertically upward from the forward edge of casing 20 and then curl downward and rearward forming generally flattened S-shaped appendages that are essentially perpendicular to tabs 22. Tabs 22 are sufficiently thin so as to be flexible and pliable and thereby permitting the user of the present invention to lift tabs 22 upward, insert razor head 13 under tabs 22, and then release tabs 22 which will snap into place and secure razor head 13 to the present invention when not in use. FIG. 7 shows the preferred embodiment of the present invention when it is separate and apart from razor 11.

Description—Alternative Embodiments

Figure 8:
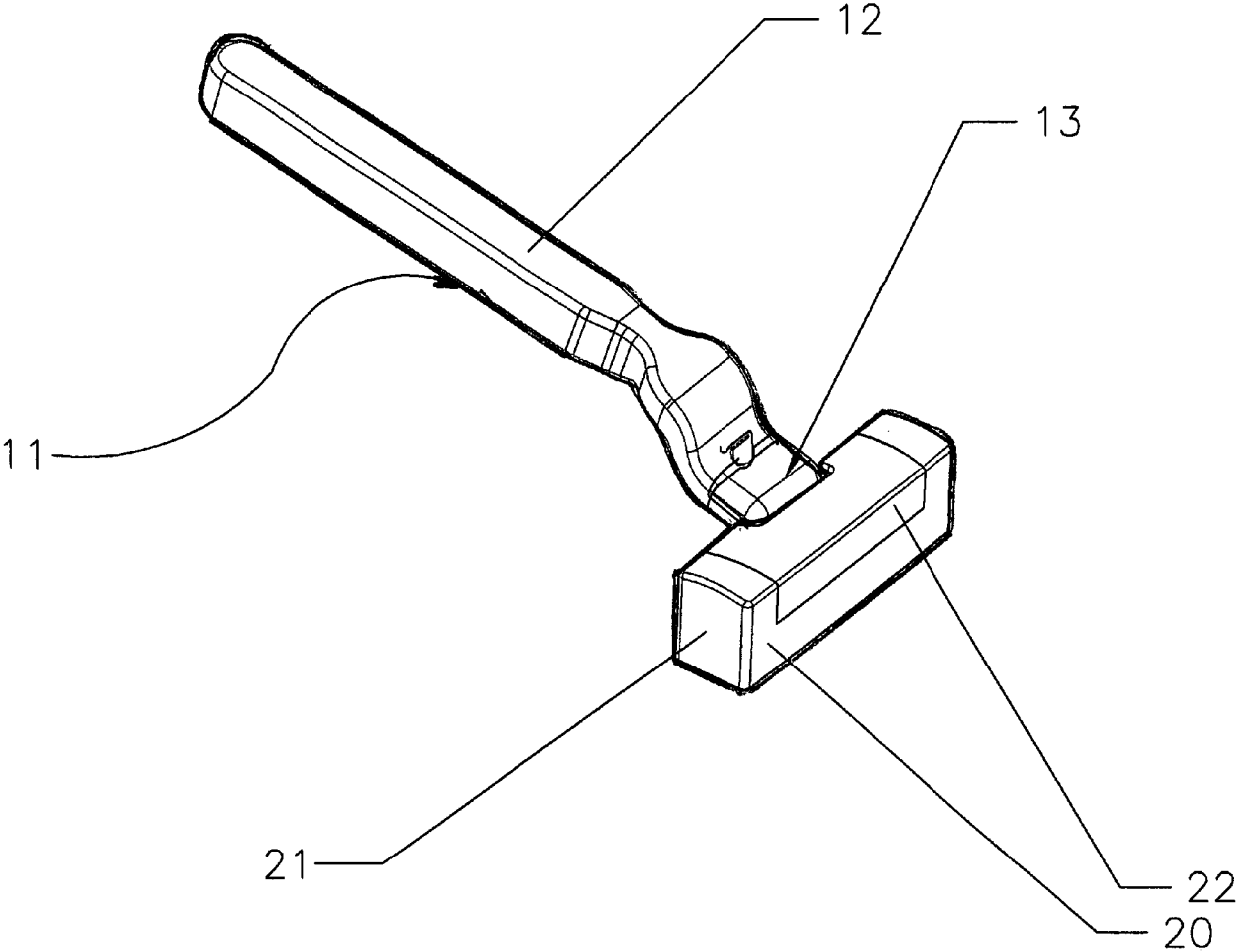
FIG. 8 is a perspective view of the embodiment shown in FIG. 5.

FIG. 8 shows a perspective view of the embodiment depicted in FIG. 5 and where razor head 13 has been inserted into and secured to the present invention. Inwardly-extended tabs 22 touch each other to form a horizontal bar and the front of casing 20 is extended upward so as to touch the horizontal bar formed by extended tabs 22 thereby creating a pocket or container open on one side into which razor head 13 is inserted said pocket constituting the means for securing this embodiment of the present invention to razor head 13.

Figure 9:
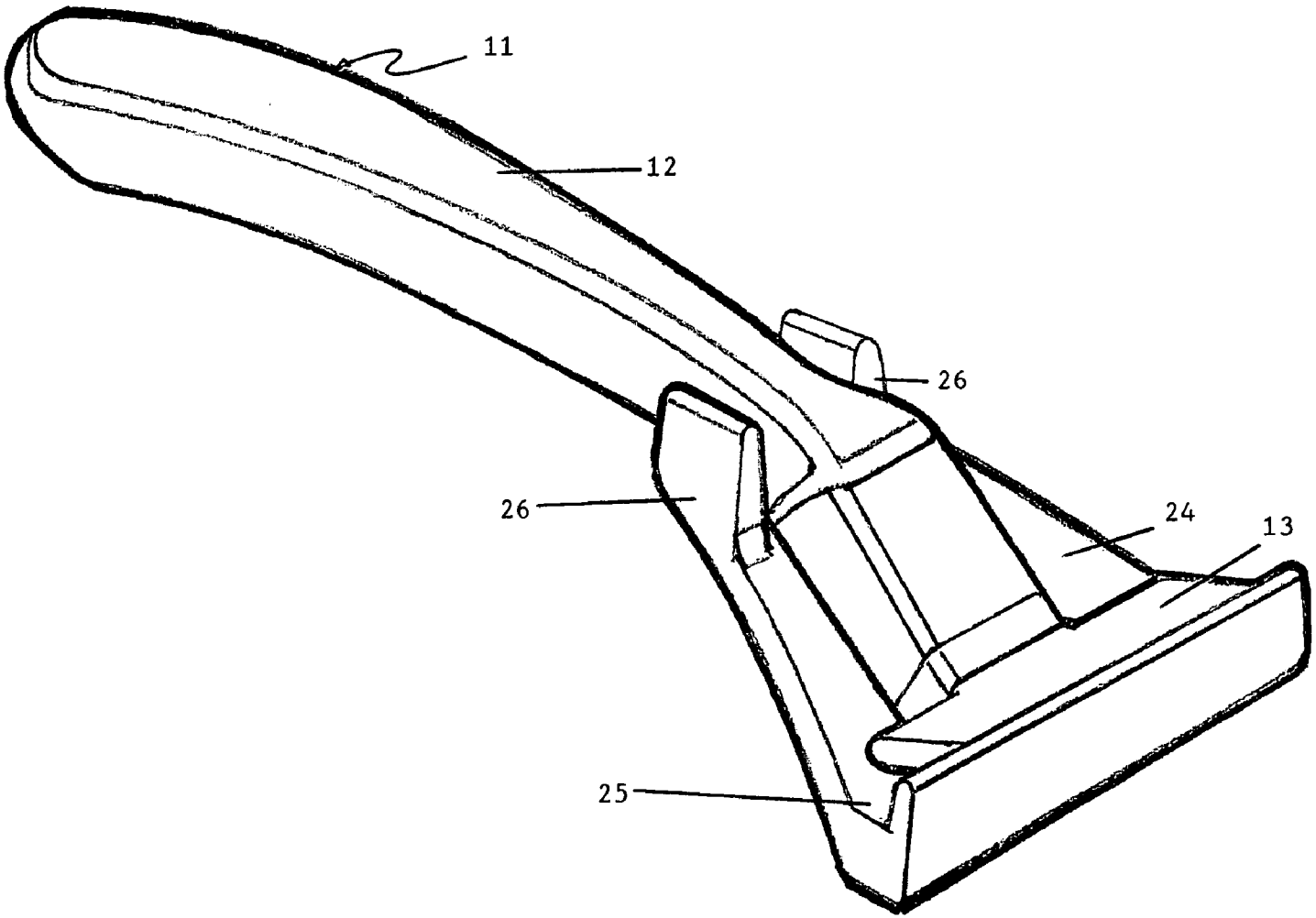
FIG. 9 is a perspective view of another embodiment of the present invention where the magnets are placed in a supporting body.

FIG. 9 shows an alternative embodiment of the present invention where magnets 23 are embedded in a supporting body 24 containing a drainable rectangular channel 25 into which razor head 13 is placed and a notched support 26 upon which handle 12 rests when razor 11 is not in use. Magnets 23 are positioned immediately below the surface of channel 25 so that the lines of magnetic flux emanating from magnets 23 will affect the blade in razor head 13 which has been positioned in channel 25. Channel 25 can be drained by any number of means including, without limitation, drain holes, opposed downward slopes from the center of channel 25, grids, mesh, and the like. This embodiment can be further modified for attachment to a vertical surface such as a shower stall by means of some attachment device such as one or more suction cups placed on the bottom of supporting body 24.

Figure 10:
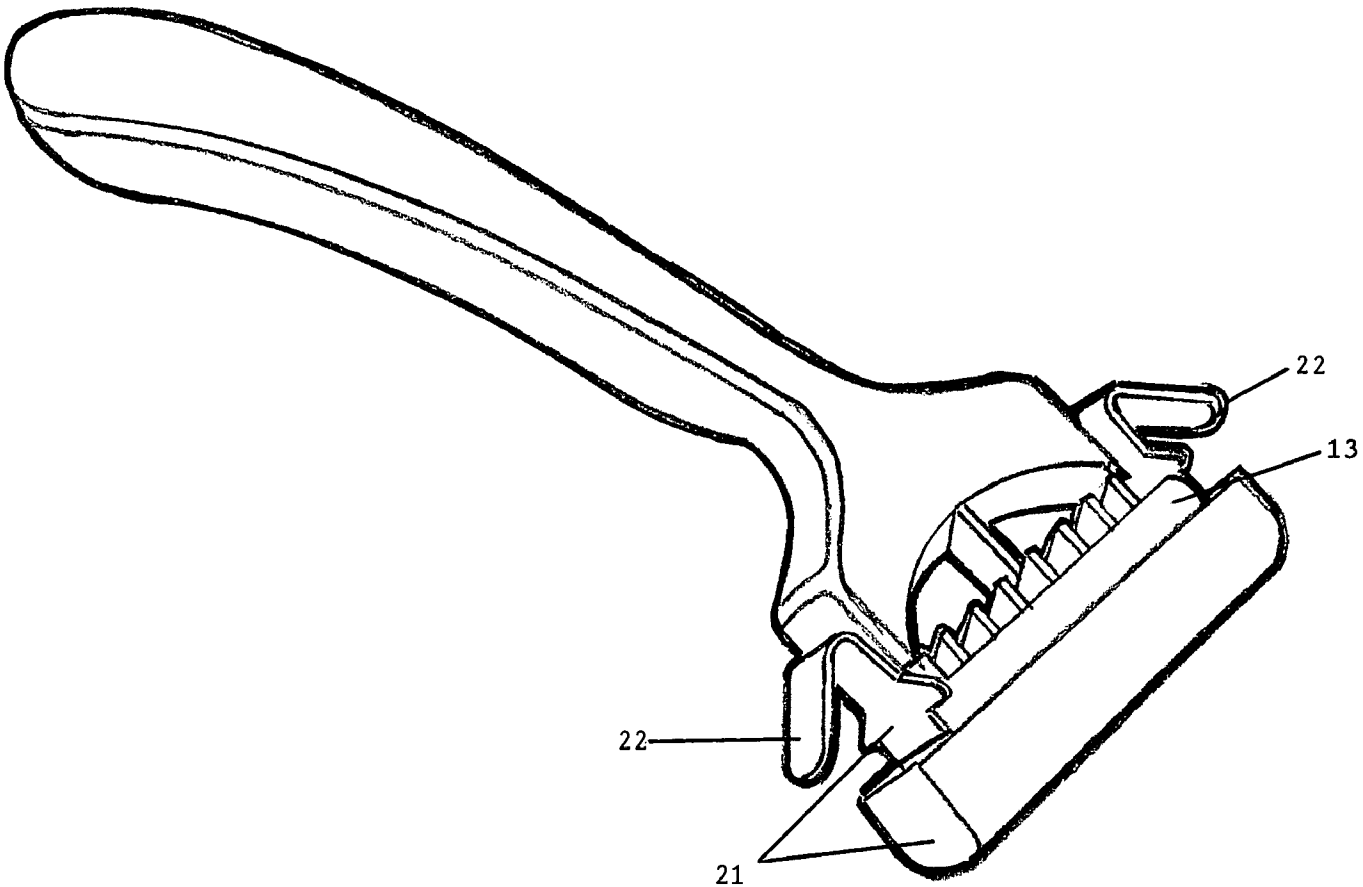
FIG. 10 is a perspective view of another embodiment of the present invention showing outwardly-directed tabs as a securing device.

FIG. 10 shows an alternative embodiment of the present invention containing tabs 22 that extend outwardly from sides 21 so as to form an appendage that can be perpendicular to or bending downwardly at an acute angle from extended sides 21. The user would depress tabs 22 so as to bend extended sides 21 slightly outward thereby permitting the user to insert razor head 13 into the present invention and then secure it by releasing tabs 22 and thereby causing extended sides 21 to snap back into place so as to come into physical contact with the outer sides of razor head 13 and hold razor head 13 in place by means of compressive force or surface friction.

While the simplest, preferred, and several alternative embodiments of the present invention have been presented and described in the context of razor blades, it should be understood that the disclosed concepts have a similar beneficial and useful application to extending the useful life of any cutting blade capable of magnetic conditioning. Accordingly, the dimensions of the present invention could be modified to fit over any device having a cutting edge such as, without limitation, kitchen knives, hunting knives, scissors, lawn mower blades, scythes and sickles, straight razors, cutting tools, garden tools, or any other device or implement having a cutting edge. These alternative uses would necessarily require a longer rectangular casing 20 to accommodate the longer cutting edge. These alternative uses would also require a different means of securing the cutting edge to rectangular casing 20 when not in use. Such means might include, without limitation, extended front and rear sides of rectangular casing 20 (instead of extended opposite narrow sides 21), tabs, tongue and groove configurations, clips, snaps, hooks, clamps, adhesives, and the like.

The simplest, preferred, and several alternative embodiments of the present invention have been presented and described using a limited number of means to secure razor head 13 to the present invention. It should be understood and appreciated that the present invention can be modified to use a large number of alternative methods of securing razor head 13 to casing 20 when not in use. These means include, without limitation, extended front and rear sides of rectangular casing 20 (instead of extended opposite narrow sides 21), tabs, tongue and groove configurations, clips, snaps, hooks, clamps, adhesives, and the like.

Operation—Simplest Embodiment

Once the user has finished shaving with razor 11, the present invention is placed over razor head 13 by slightly deflecting one or both sides 21 outward so as to permit sliding the present invention over razor head 13 so that the outwardly extended blades of razor head 13 are in contact with the upper surface of casing 20. Once casing 20 is in place over razor head 13, the slightly deflected side(s) 21 is(are) released allowing it(them) to snap back into place so that each side 21 is adjacent to and in physical contact with an opposite end of razor head 13.

Operation—Preferred Embodiment

Once the user has finished shaving with razor 11, the present invention is placed over razor head 13 by slightly deflecting tabs 22 upward so as to permit sliding the present invention over razor head 13 so that the outwardly extended blades of razor head 13 are in contact with the upper surface of casing 20. Once casing 20 is in place under razor head 13, the slightly deflected tabs 22 are released allowing them to snap back into place so that each tab 22 is in physical contact with the upper surface of razor head 13 thereby holding razor head 13 firmly and securely in place.

It should be further understood that variations and modifications and special adaptations of the preferred embodiment of the present invention may be utilized without departing from the scope of the present invention as set forth in the following claims.

CONCLUSION, RAMIFICATION, AND SCOPE

The present invention represents a significant improvement over blade sharpening devices disclosed by the prior art. Specifically, the present invention is a lightweight, inexpensive, and portable device for sharpening and maintaining the sharpness of a cutting edge inserted therein. While most, if not all of the inventions taught by the prior art are bulky, cumbersome, and non-portable, the present invention is, in all of its embodiments, quite portable and will easily fit into the owner's shaving kit or overnight bag.

Further, the present invention uses an unconventional and innovative linear, end-to-end placement of rectangular bar magnets whereby like poles are adjacent to one another. This particular disposition challenges and departs from the accepted notion and conventional alignment whereby opposite poles are positioned adjacent to one another. The innovative alignment taught by the present invention creates a more efficient magnetic field that will keep the blades inserted therein sharper for a longer period of time. Further still, the present invention can use its innovative alignment of bar magnets to maintain the sharpness of any cutting edge, not just a razor or razor blades.

We claim:

1. A transportable magnetic blade-sharpening device comprising:

a. a rectangularly shaped casing uniformly cast from nonferrous material;

b. two or more elongated rectangularly shaped magnets forming longitudinal axes and each magnet having two opposite planar polar end surfaces perpendicular to the longitudinal axes, said magnets being aligned in an a polar end-to-polar end, like-poles-facing one another-and-touching disposition within said casing; and c. a means for firmly attaching and securing said casing to a head of a hand-held shaving device when said hand-held shaving device is not in use.

2. The device according to claim 1 wherein said means consists of extended sides formed from two semi-rigid rectangular strips composed of a material identical to said nonferrous material composing said casing and extending perpendicularly from said casing's upper surface at or near opposite narrow sides of said casing.

3. The device according to claim 1 wherein said means consists of extended sides formed from two semi-rigid rectangular strips composed of a material different from said nonferrous material composing said casing and extending perpendicularly from said casing's upper surface at or near opposite narrow sides of said casing.

4. The device according to claim 1 wherein said means consists of tabs formed from two semi-rigid rectangular strips composed of a material identical to said nonferrous material composing said casing and extending perpendicularly from said casing's upper surface at or near opposite narrow sides of said casing and then bending inward at substantially right angles so as to form short tabs.

5. The device according to claim 1 wherein said means consist of tabs formed from two semi-rigid strips composed of a material different from that composing said casing and extending perpendicularly from said casing's upper surface at or near opposite narrow sides of said casing and then bending inward at substantially right angles so as to form short tabs.

6. The device according to claim 4 wherein said tabs touch each other.

7. The device according to claim 5 wherein said tabs touch each other.

8. The device according to claim 1 wherein said means consists of extended sides with tabs formed from two semi-rigid rectangular strips composed of a material identical to said nonferrous material composing said casing and extending perpendicularly from said casing's upper surface at or near opposite narrow sides of said casing and then bending outward and back upon themselves at acute angles.

9. The device according to claim 1 wherein said means consists of extended sides with tabs formed from two semi-rigid rectangular strips composed of a material different from that composing said casing and extending perpendicularly from said casing's upper surface at or near opposite narrow sides of said casing and then bending outward and back upon themselves at acute angles.

10. The device according to claim 1 wherein said means consists of tabs with a flattened S-shaped configuration formed from two semi-rigid rectangular strips composed of a material identical to said nonferrous material composing said casing and extending perpendicularly from said casing's front edge and upper surface and then curling upward, downward and upward again in a rearward direction.

11. The device according to claim 1 wherein said means consists of tabs with a flattened S-shaped configuration formed from two semi-rigid rectangular strips composed of a material different from that composing said casing and extending perpendicularly from said casing's front edge and upper surface and then curling upward, downward and upward again in a rearward direction.

12. The device according to claim 1 wherein said means consists of a compartment open on its rearward face and formed by extending said casing's sides, forward edge, and upper surface perpendicularly from said upper surface of said casing.

13. The device according to claim 1 wherein said casing consists of a moldable body capable of supporting a hand-held shaving device and said means consists of a drainable channel longitudinally disposed above and parallel to said magnets.

14. The device according to claim 13 further comprising a means for attaching and securing said casing to a vertical surface.

15. The device according to claim 14 wherein said means is a suction cup.

16. The device according to one of claims 1-15 wherein said casing is composed of plastic, rubber, or epoxy or other suitable nonferrous material.

17. A method for extending a cutting edge's life comprising steps of:

a. placing two or more elongated rectangularly-shaped permanent magnets in a suitable casing, said magnets forming longitudinal axes and each magnetic having two opposite planar polar end surfaces perpendicular to the longitudinal axes, wherein said magnets being disposed in a polar end-to-polar end alignment so that magnetic charges on any two of said planar polar end surfaces of any two of said magnets adjoining and facing each other are identical;

b. providing a cutting edge; and c. attaching said cutting edge to said casing in such a manner that said cutting edge is parallel to and above said magnets.

* * * * *